US005961098A

United States Patent [19]

Loan

[11] Patent Number: 5,961,098

[45] Date of Patent: Oct. 5, 1999

[54] LIFTING JACK SUPPORT SYSTEM

[76] Inventor: Chung Loan, 4F, No.6, Lane 48, Yen Chi Street, Taipei, Taiwan

[21] Appl. No.: 08/878,300

[22] Filed: Jun. 18, 1997

[51] Int. Cl.[6] ..... B66F 3/00

[52] U.S. Cl. ..... 254/133 R; 254/8 B; 254/134

[58] Field of Search ..... 248/351, 352, 248/354.1, 354.7, 354.5, 354.6; 254/1, 8 B, 133 R, 2 B, 124, 134

[56] References Cited

U.S. PATENT DOCUMENTS

| | | | |
|---|---|---|---|
| 1,520,590 | 12/1924 | Miller | 254/133 R |
| 1,541,306 | 6/1925 | Young | 254/133 R |
| 1,975,969 | 10/1934 | Nelson | 254/133 R |
| 1,994,015 | 3/1935 | Curran | 254/133 R |
| 5,462,257 | 10/1995 | Trowbridge | 254/8 B |
| 5,618,029 | 4/1997 | Chung | 254/8 B |

*Primary Examiner*—Ramon O. Ramirez
*Assistant Examiner*—Gwendolyn Baxter
*Attorney, Agent, or Firm*—Pro-Techtor International Services

[57] ABSTRACT

The present invention relates to a lifting jack support system for supporting an object to be lifted by a lifting jack with a movable top side, the lifting jack support system comprising: a base unit, mounted on the top side of the lifting jack, having a support arm extending away with a front end, with one or several positioning plates fastened on the top side of the base unit, a gap lying within or between the positioning plates; and a top unit, having a link arm, which is hingedly connected to the front end of the support arm, and one or several positioning elements, the top unit either resting on the base unit, with the positioning elements fitting into the gap, or being folded away therefrom, such that starting positions at two different heights for lifting the object are provided.

6 Claims, 10 Drawing Sheets

LIFTING JACK SUPPORT SYSTEM

BACKGROUND OF THE INVENTION

1. Field of the Invention

The present invention relates to a lifting jack support system, particularly to a lifting jack support system for cars with both low and high ground clearance.

2. Description of Related Art

A conventional car lifting jack, as shown in FIGS. 9 and 10, comprises: a main body 90; a lifting system 91 with a lifting arm 92, which is hingedly connected to the main body 90, and a support element 93 on the top of the lifting arm 92; and a driving system 94 for raising the lifting arm 92 with the support element 93 and an object to be lifted.

The maximum lifting height of a hydraulic conventional car lifting jack is about equal to the combined heights of the lifting arm 92 and the support element 93. Since the lifting arm 92 has a fixed size, a certain minimum and maximum lifting height are given. Therefore, cars with low ground clearance and cars with high ground clearance require different car lifting jacks. A lifting jack with a large maximum lifting height often is not applicable to a car with low ground clearance. Furthermore, it is heavy and uncomfortable to use. On the other hand, a lifting jack with a small maximum lifting height requires a extra layer of support for cars with high ground clearance, making its use unsafe.

SUMMARY OF THE INVENTION

An object of the present invention is to provide a lifting jack support system for cars with low ground clearance.

Another object of the present invention is to provide a lifting jack support system for cars with high ground clearance.

A further object of the present invention is to provide a lifting jack support system, which is safe and easy to use.

The present invention can be more fully understood by reference to the following description and accompanying drawings.

DETAILED DESCRIPTION OF THE PREFERRED EMBODIMENTS

The present invention provides a lifting jack support system to be used on a lifting jack for lifting an object from both a low support position and a high support position. It is explained below using a car with low or high ground clearance as an example. This example, however does not limit the scope of the present invention.

Figure 1:
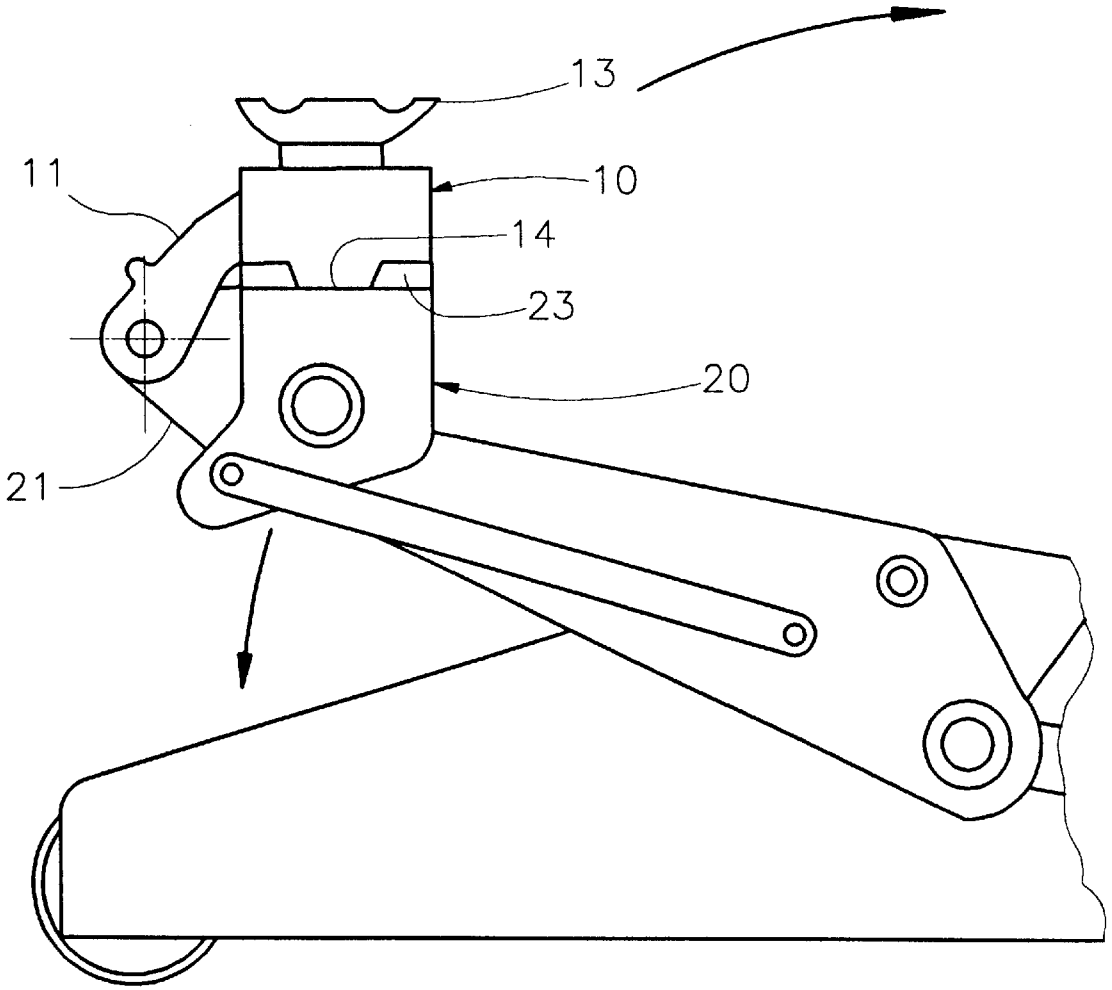
FIG. 1 is a side view of the lifting jack support system of the present invention.
Figure 2:
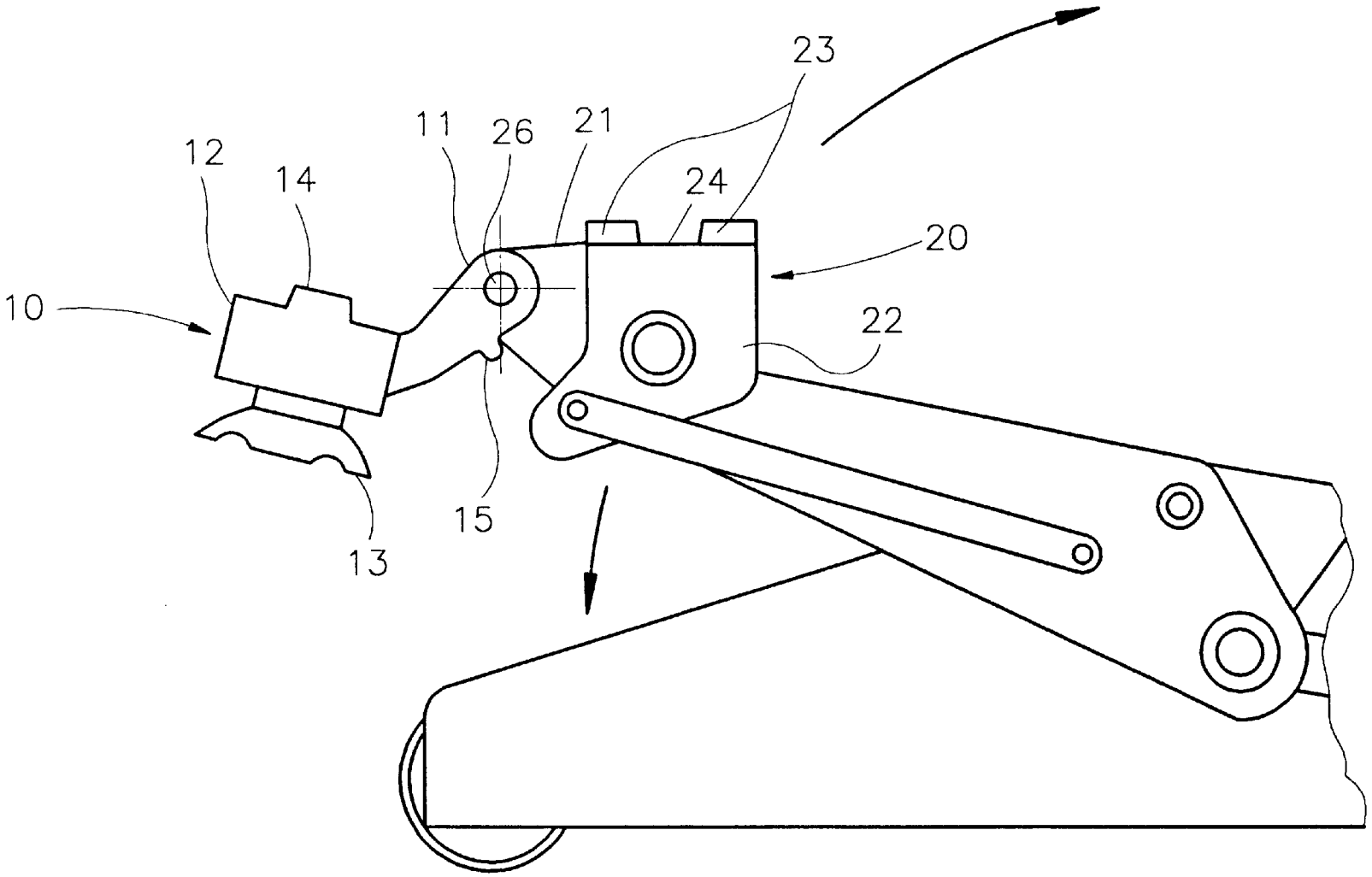
FIG. 2 is a side view of the top element of the present invention, when folded away.
Figure 3:
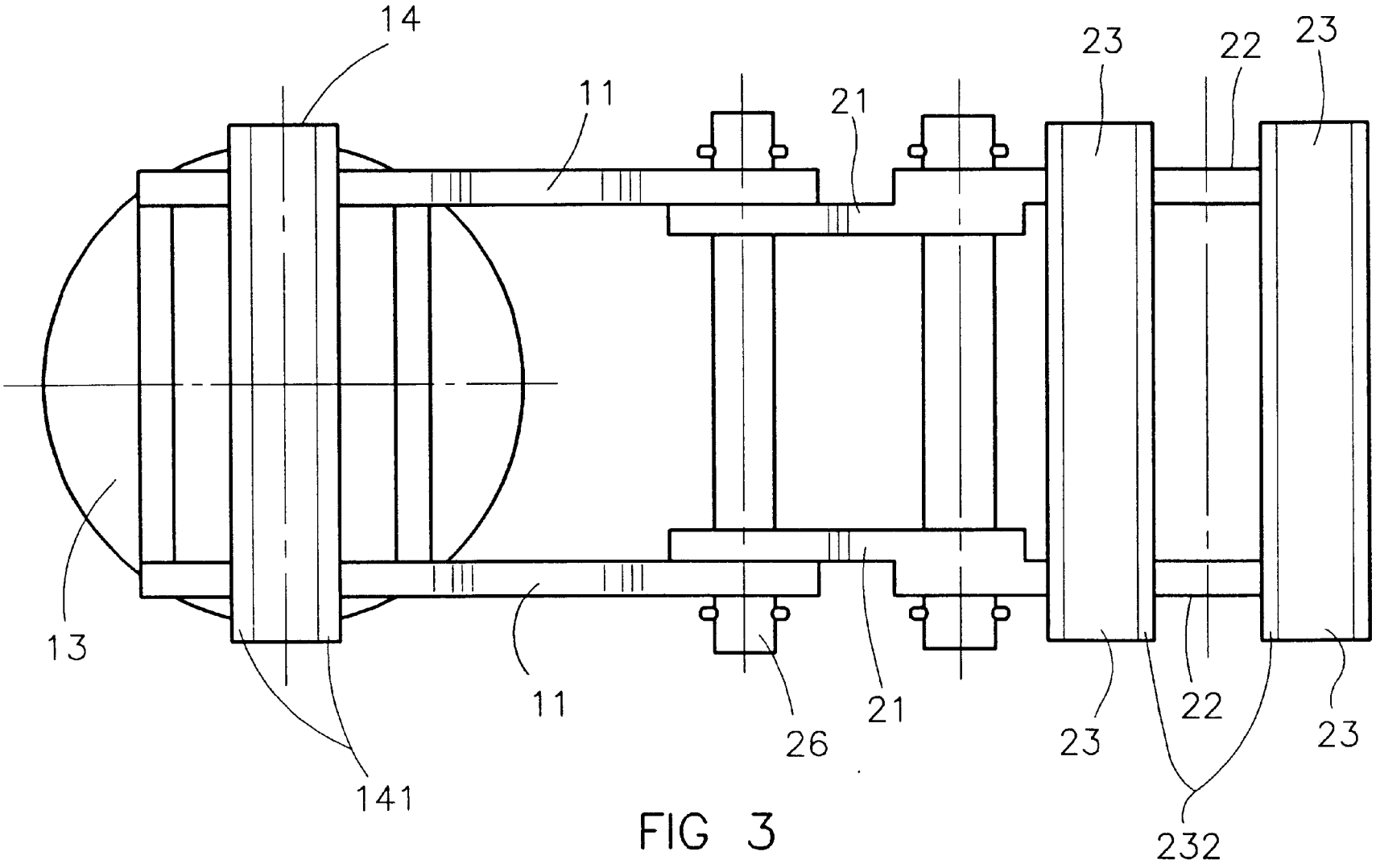
FIG. 3 is a top view of the top element of the present invention, when folded away.

As shown in FIGS. 1–3, the lifting jack support system of the present invention is substituted for the top element 93 of a conventional lifting jack. It mainly comprises a top unit 10 and a base unit 20. The top unit 10 has an upper part, which is the same as the upper part of the top element 93 of a conventional lifting jack. The base unit 20 has a lower part, which is the same as the lower part of the top element 93 of a conventional lifting jack. The FIGS. 1–3 show a simplified lifting jack, on which the lifting jack support system of the present invention rests.

Figure 4:
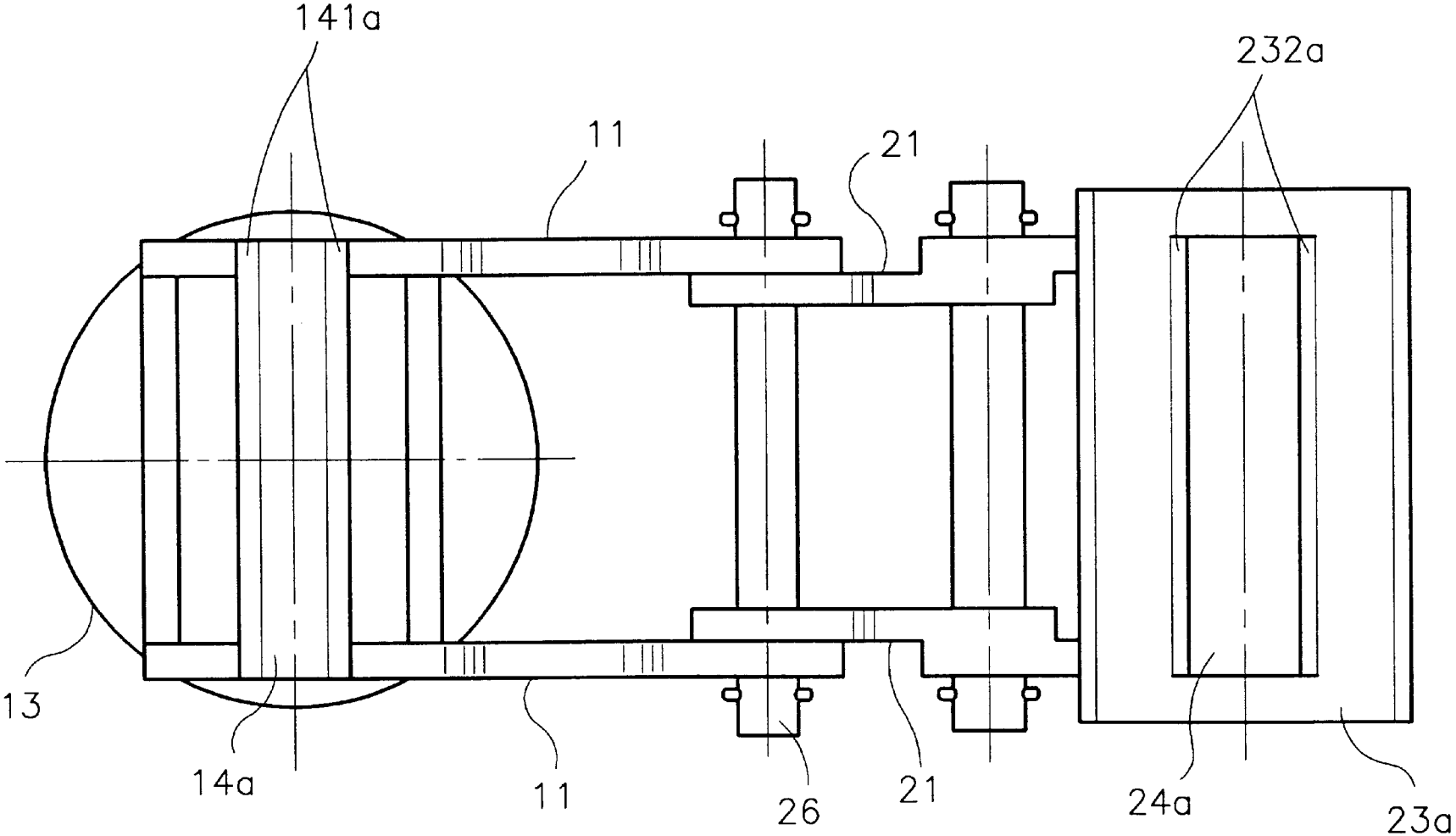
FIG. 4 is a top view of the top element, when folded away, in a second embodiment of the present invention.

Referring to FIG. 4, the lifting jack support system of the present invention in a second embodiment has a base unit 20 with a support arm 21, to which a link arm 11 of a top unit 10 is connected.

As shown in FIGS. 1–3, the base unit 20 comprises two side plates 22, two positioning plates 23, which are horizontally mounted on the side plates 22 with a gap 24 in between, and two support arms 21, to which the top unit 10 is connected. The base unit 20 is mounted on the lifting jack at two holes. (This is the same method as mounting the top element of a conventional lifting jack on the lifting jack and needs no further explaining.) The top unit has a link arm 11, which is hingedly connected to the support arms 21 with a far end, being rotatable around a horizontal shaft 26.

The top unit 10 further has a main body 12, which is fixed to the link arm 11 at the far end thereof, and a support pan 13, mounted on the main body 12. (The support pan 13 is the same as upper side of the top element of a conventional lifting jack on the lifting jack and needs no further explaining.) Opposite to the support pan 13, a positioning element 14 is attached to the main body 12.

By turning the top unit 10 around the shaft 26, the top unit 10 is either set on the base unit 20 or folded away. When the top unit 10 sits on the base unit 20, the positioning element 14 fits into the gap 24.

For lifting a car with low ground clearance, the top unit 10 is folded away from the base unit 20. The car, having a body with a rim at the bottom thereof, is supported by the base unit 20, with the rim resting in the gap 24. Thereby the car is stably supported. The positioning plates 23 are about 7–9 cm lower than the upper side of the top element of a conventional lifting jack, so cars with low ground clearance are lifted conveniently.

For lifting a car with high ground clearance, the top unit 10 is set on the base unit 20. Then the positioning element 14 lies in the gap 24 between the positioning plates 23, and the rim at the bottom of the car body rests on the support pan 13. Lifting the car is performed in the same way as with a conventional lifting jack. The positioning pan 13 is about 7–9 cm higher than the upper side of the top element of a conventional lifting jack, so cars with high ground clearance are lifted conveniently.

The design of the top unit 10 allows for a lifting jack with reduced lifting amplitude and thus of a shorter length. A conventional lifting jack for lifting a car with high ground clearance requires a long lifting arm 92, which makes it heavy, hard to store and inconvenient to use. The present invention allows to use a compact lifting jack, even for lifting a car with high ground clearance, without the need for additional supporting layers of, e.g., wood or bricks that bring safety risks. Of course, the present invention is suitable for larger lifting jacks, in order to lift cars or other objects with an even higher ground clearance.

Figure 7:
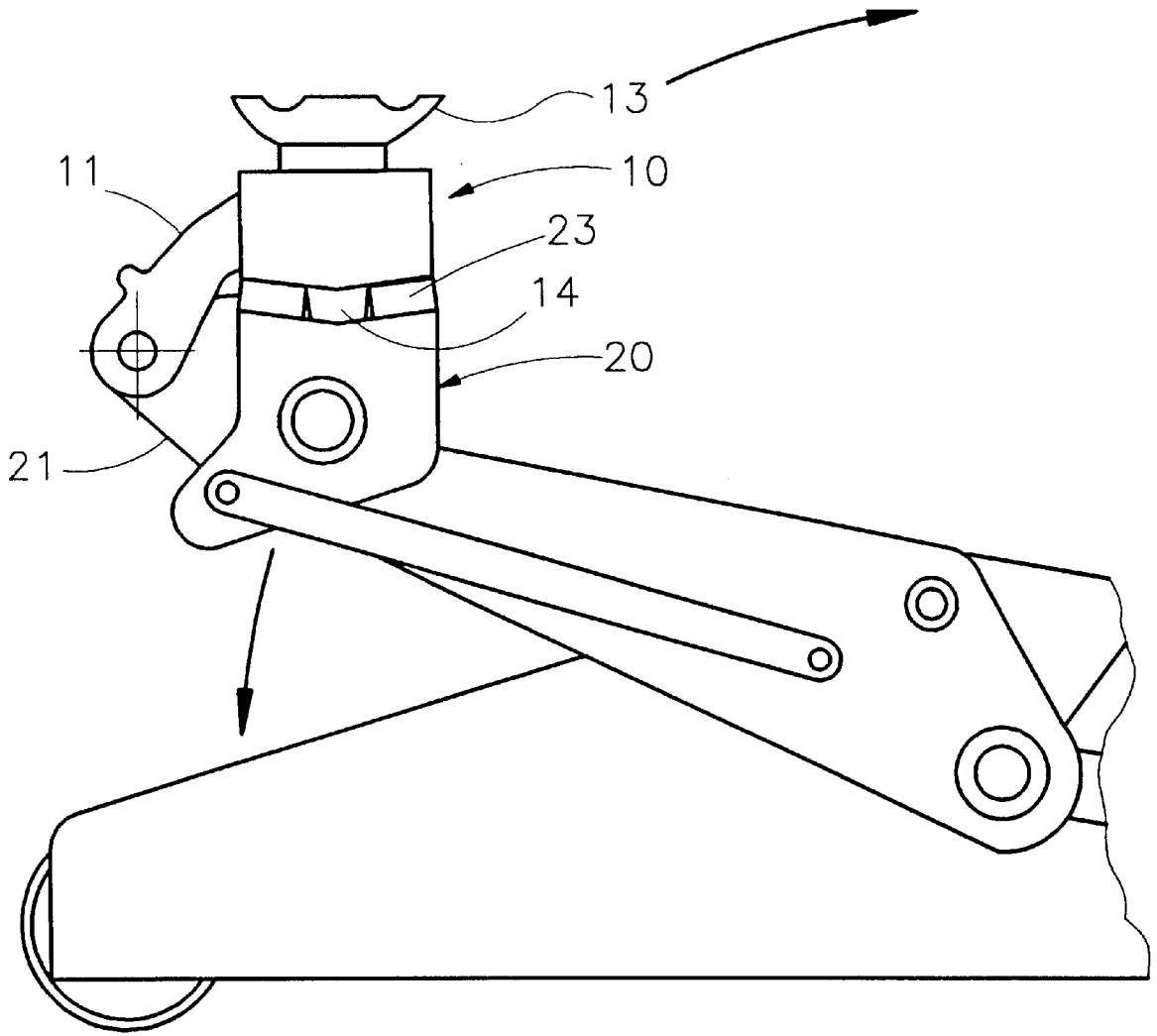
FIG. 7 is a side view of the lifting jack support system of the present invention in a fifth embodiment.
Figure 8:
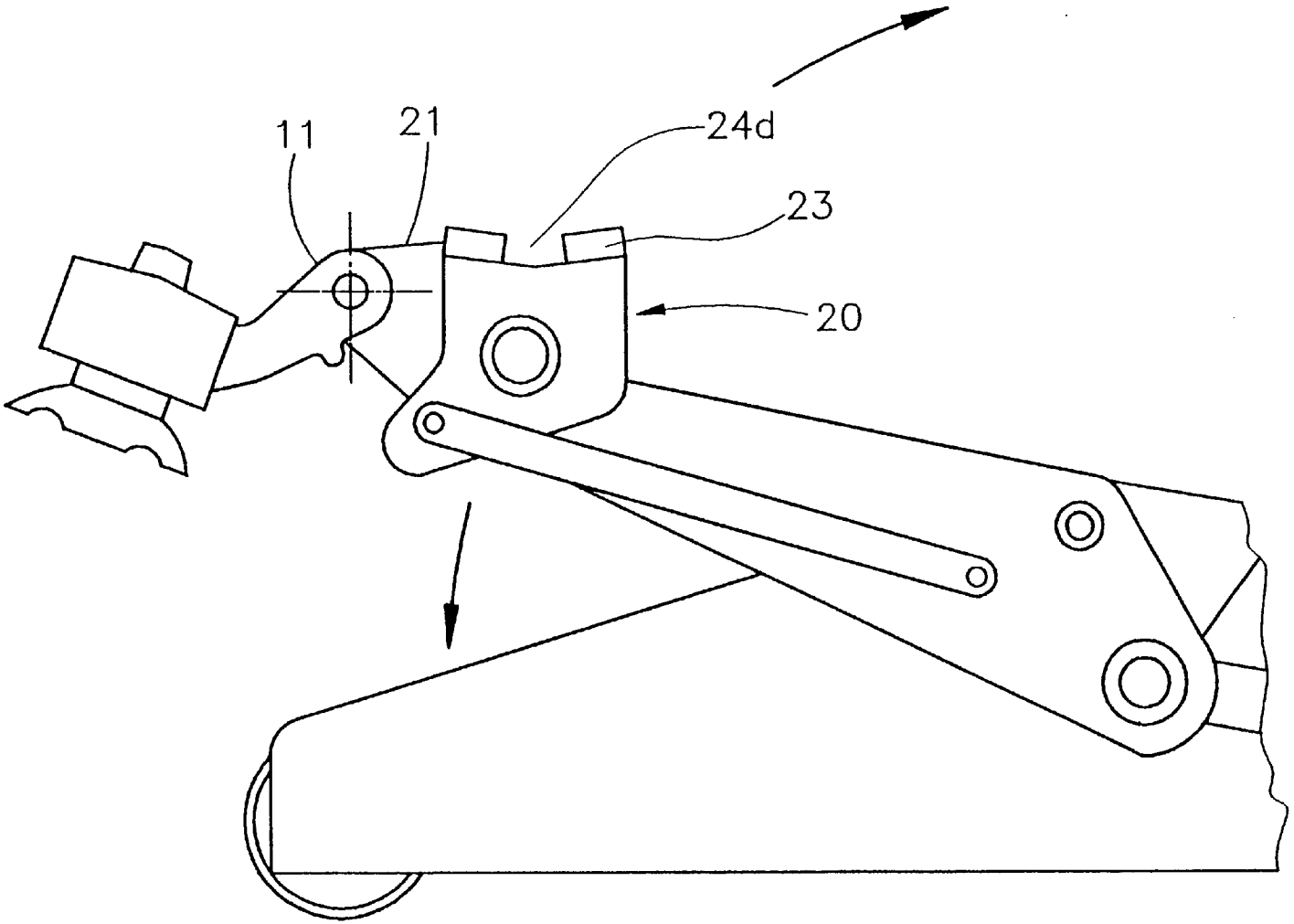
FIG. 8 is a side view of the top element, when folded away, in a fifth embodiment of the present invention.
Figure 9:
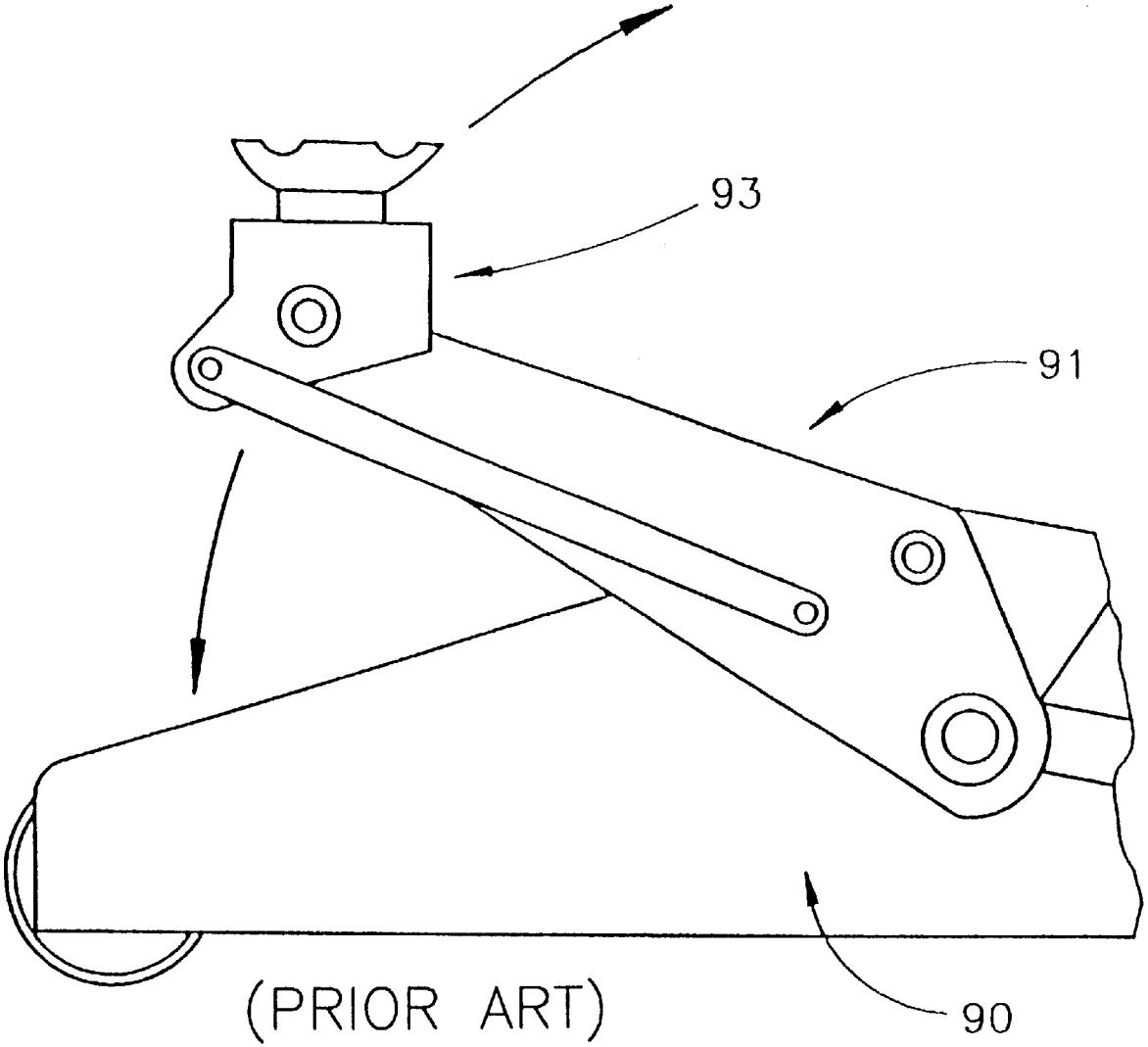
(PRIOR ART) FIG 9
FIG. 9 (prior art) is a simplified schematic illustration of a conventional lifting jack.
Figure 10:
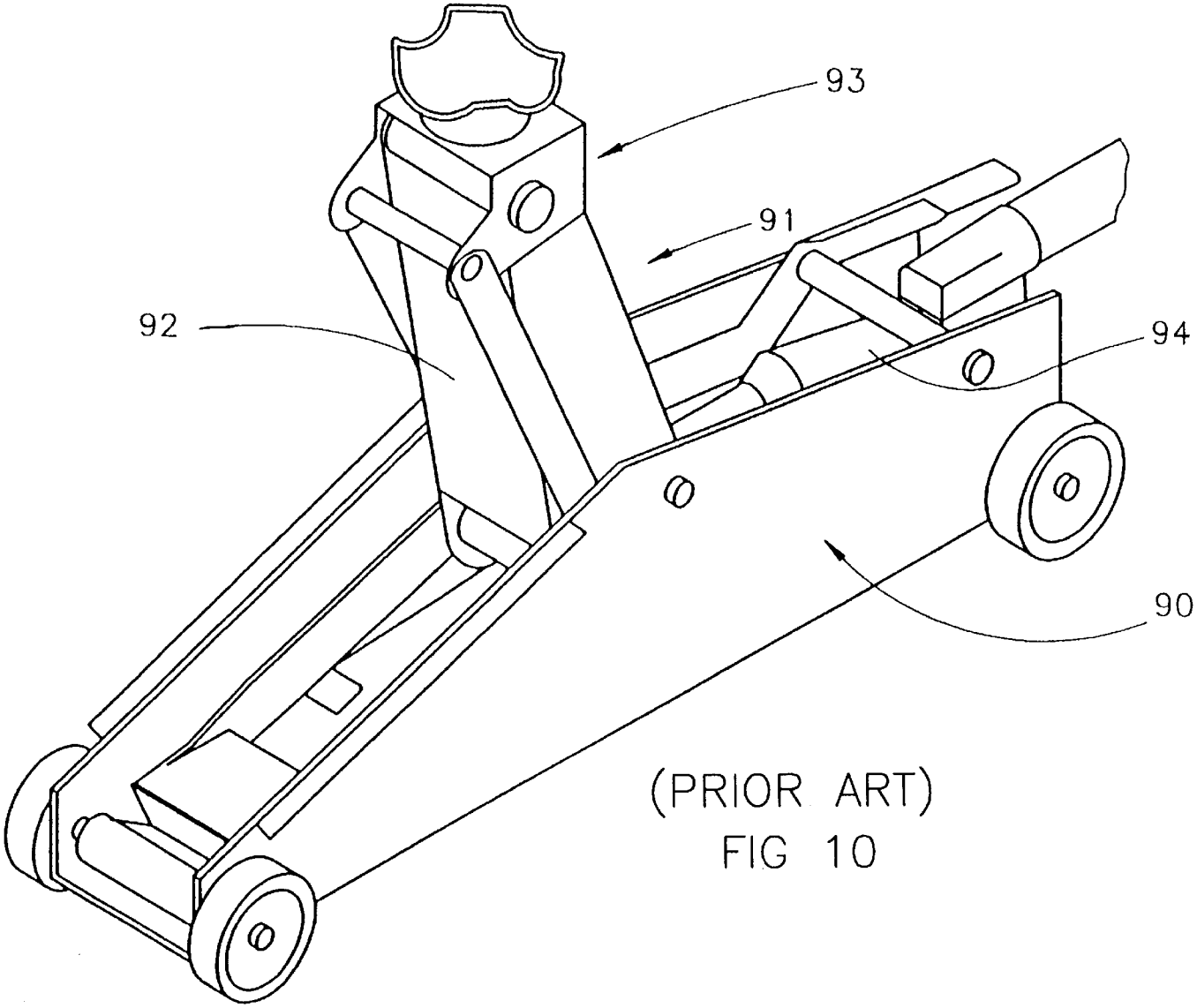
(PRIOR ART) FIG 10
FIG. 10 (prior art) is a perspective view of a conventional lifting jack.

For more safety, the present invention in another embodiment employs side plates 22, the top side of which is V-shaped. As shown in FIGS. 7 and 8, the two positioning plates 23 are then inclined towards each other, leaving a gap 24*d* in between. If the rim at the bottom of the body of a car with low ground clearance is not properly set into the gap 24*d*, and the lifting jack is raised, the lifting jack will move automatically to let the rim slip into a proper position in the gap 24*d*. The same effect is attained, when using side plates 22 with horizontal top sides and two positioning plates 23, the top sides of which are inclined towards each other.

Referring to FIGS. 2 and 3, the top side of the support arm 21 is inclined downwards, when proceeding away from the side plates 22. Thus, if the rim at the bottom of the body of a car with low ground clearance is set outside the gap 24, and the lifting jack is raised, the lifting jack will move automatically to let the rim slip down the top side of the support arm 21, alerting the user.

The top side of the link arm 11 is inclined downwards to its far end, as well. Therefore, even if the rim at the bottom of the body of a car with low ground clearance is set on the link arm 11, and the lifting jack is raised, the lifting jack will move automatically to let the rim slip down the top side of the link arm 11, alerting the user.

When the top unit 10 is folded away from the base unit 20 by turning it around the shaft 26, it is kept in a certain angular position by a blocking element 15, which protrudes from the link arm 11 and leans against the support arm 21.

Referring to FIGS. 3 and 4, the present invention in a second embodiment employs a single support plate 23*a* with a middle opening 24*a*. A positioning element 14*a* on the top unit 10 fits into the middle opening 24*a* of the support plate 23*a*, when the top unit 10 is set on the base unit 20. The positioning elements 14, 14*a* have sloping edges 141, 141*a*, which fit on sloping edges 232, 232*a* on the support plates 23, 23*a* for stable positioning the top unit 10 on the base unit 20.

Figure 5:
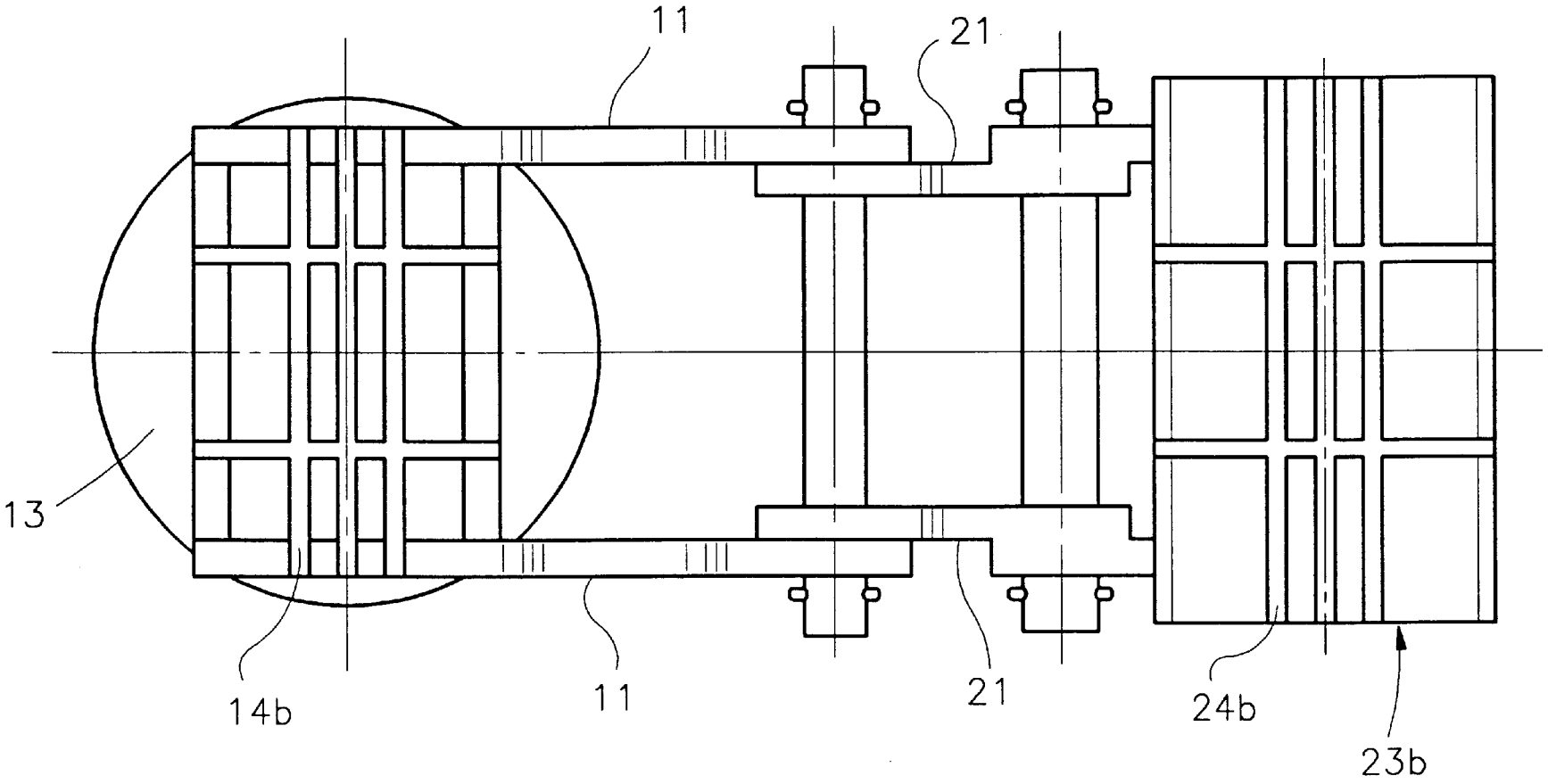
FIG. 5 is a top view of the top element, when folded away, in a third embodiment of the present invention.

Referring to FIG. 5, the present invention in a third embodiment has a support plate 23*b* with a plurality of crosswise arranged grooves 24*b*. A grid of positioning bars 14*b*, attached to the top element 10, fits into the grooves 24*b*.

Figure 6:
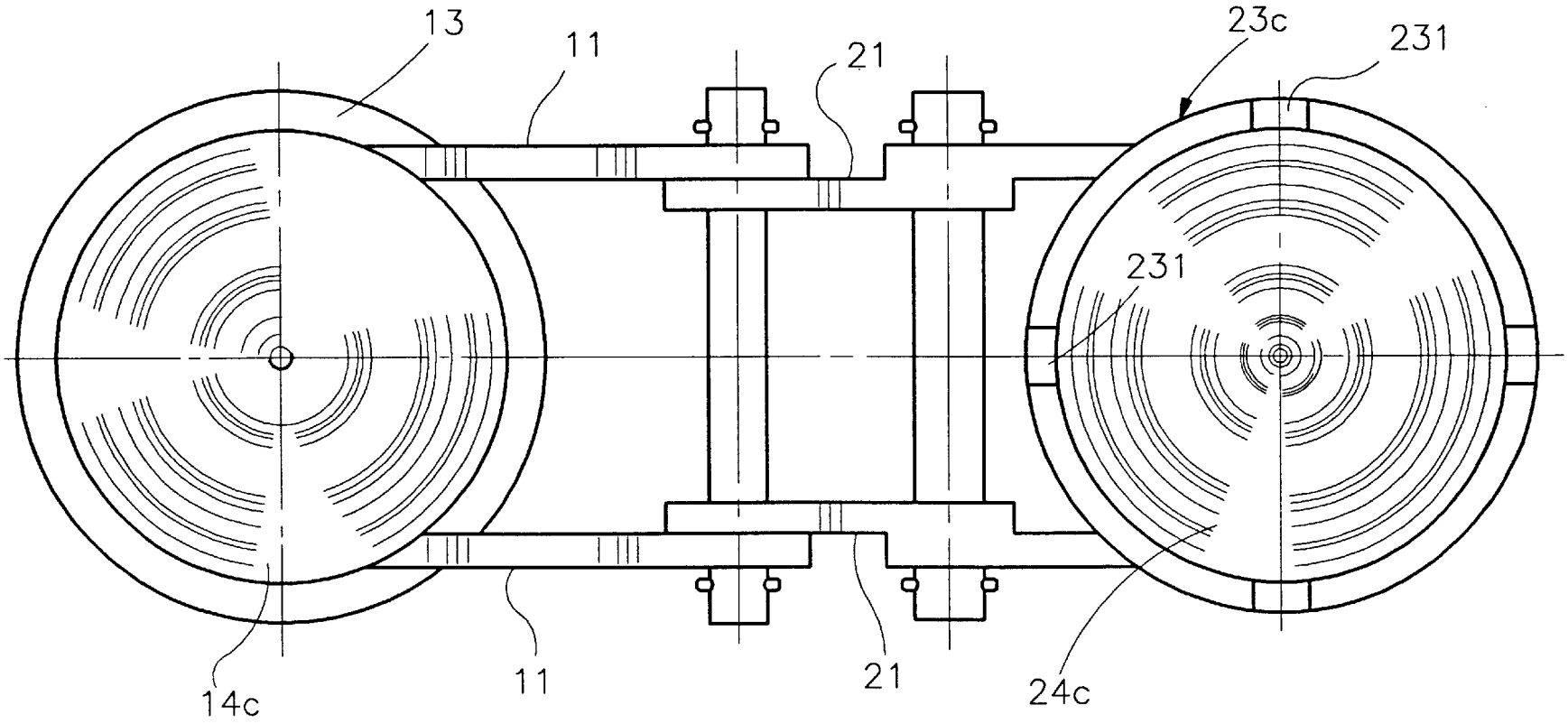
FIG. 6 is a top view of the top element, when folded away, in a fourth embodiment of the present invention.

Referring to FIG. 6, the present invention in a fourth embodiment has a support plate 23*c* with a rim and a circular depression 24*c*. A circular projection 14*c*, attached to the top element 10, fits into the depression 24*c*. In order to prevent an object resting on the support plate 23*c* from slipping away, the rim of the support plate 23*c* is provided with several holding notches 231.

Furthermore, for special requirements, the support plate on the base unit is implemented as a projecting element, with the positioning element being formed as a depression fitting thereon.

While the invention has been described with reference to preferred embodiments thereof, it is to be understood that modifications or variations may easily be made without departing from the spirit of this invention, which is defined by the appended claims.

What is claimed is:

1. A lifting jack support system for supporting an object to be lifted by a lifting jack with a movable top side, said lifting jack support system comprising:

a base unit with a front side and a top side, said base unit is mounted on said top side of a lifting jack, said base unit includes a support arm with a front end, and at least one positioning plate fastened on said top side of said base unit, a gap being formed in said at least one positioning plate, or said gap is formed between said positioning plates if more than one said positioning plate is utilized; and a top unit having a link arm which is hingedly connected to said front end of said support arm, and at least one positioning element, said top unit either resting on said base unit, with said at least one positioning element fitting into said gap, or being folded away therefrom, such that starting positions at two different heights for lifting said object are provided.

2. The lifting jack support system according to claim 1, wherein said support arm has an upper side which is inclined downward toward said front end.

3. The lifting jack support system according to claim 1, wherein said link arm is sloped downward away from said support arm when said top unit is folded away from said base unit.

4. The lifting jack support system according to claim 1, wherein said gap has sloping edges.

5. The lifting jack support system according to claim 1, wherein said positioning elements have sloping edges.

6. The lifting jack support system according to claim 1, wherein said positioning plates form a depression and said positioning elements form a projection which fits on said positioning plates.

* * * * *